US010743636B2

(12) United States Patent
Bushell

(10) Patent No.: US 10,743,636 B2
(45) Date of Patent: Aug. 18, 2020

(54) REFILLABLE STICK DEODORANT DISPENSER

(71) Applicant: BY HUMANKIND, INC., New York, NY (US)

(72) Inventor: Brian Craig Bushell, New York, NY (US)

(73) Assignee: BY HUMANKIND, INC., New York, NY (US)

( * ) Notice: Subject to any disclaimer, the term of this patent is extended or adjusted under 35 U.S.C. 154(b) by 5 days.

(21) Appl. No.: 16/157,747

(22) Filed: Oct. 11, 2018

(65) Prior Publication Data

US 2019/0133298 A1 May 9, 2019

Related U.S. Application Data

(60) Provisional application No. 62/581,476, filed on Nov. 3, 2017.

(51) Int. Cl.

| | |
|---|---|
| ***A45D 40/06*** | (2006.01) |
| ***A45D 40/16*** | (2006.01) |
| ***A45D 40/04*** | (2006.01) |
| ***A45D 40/20*** | (2006.01) |
| ***B65D 83/00*** | (2006.01) |

(52) U.S. Cl.

CPC ..... *A45D 40/06* (2013.01); *A45D 40/04* (2013.01); *A45D 40/16* (2013.01); *B65D 83/0011* (2013.01); *A45D 2040/208* (2013.01)

(58) Field of Classification Search

CPC ..... A45D 40/06; A45D 40/16; A45D 40/14; A45D 40/04; A45D 40/02; A45D 2040/205; A45D 2040/208; B65D 83/0005; B65D 83/0011

See application file for complete search history.

(56) References Cited

U.S. PATENT DOCUMENTS 5,437,513 A * 8/1995 Favre ..... A45D 40/04 401/175

8,187,578 B2 * 5/2012 Walling ..... A45D 40/16 424/65

OTHER PUBLICATIONS

Myro Deodorant refillable cases on the Internet at <URL: https://www.mymyro.com/>; retrieved from the Internet on Aug. 12, 2019.

* cited by examiner

*Primary Examiner* — David J Walczak

(74) *Attorney, Agent, or Firm* — Schwabe Williamson & Wyatt, PC

(57) ABSTRACT

Embodiments include reusable stick deodorant containers and associated inserts. The container includes a rotatable detachable base that allows an empty insert to be removed and replaced with a full insert. Each insert includes a screw and a follower that engages the screw. The screw engages the detachable base following insertion into the container, so that rotating the base causes the screw to rotate, moving the follower through the insert and expelling the end of a deodorant stick that is disposed upon the follower.

11 Claims, 3 Drawing Sheets

SECTION A-A

DETAIL B

REFILLABLE STICK DEODORANT DISPENSER

CROSS REFERENCE TO RELATED APPLICATIONS

The present application claims priority to U.S. provisional application 62/581,476, filed on 3 Nov. 2017, the content of which is hereby incorporated by reference in its entirety.

TECHNICAL FIELD

The present disclosure relates to the field of personal hygiene products, and specifically to a refillable stick deodorant dispenser.

BACKGROUND

Personal hygiene routines for most people include the application of deodorant, which can include antiperspirants. Such products may be packaged in different form factors, such as aerosol, liquid, gel, or solid stick. Solid sticks are typically comprised of active ingredients including perfumes, scents, and/or other substances that reduce or eliminate underarm odor, substances that stop or absorb perspiration (in the case of antiperspirants), and various other inert ingredients such as binders, preservatives, and emulsifiers.

BRIEF DESCRIPTION OF THE DRAWINGS

Embodiments will be readily understood by the following detailed description in conjunction with the accompanying drawings. Embodiments are illustrated by way of example and not by way of limitation in the figures of the accompanying drawings.

DETAILED DESCRIPTION OF DISCLOSED EMBODIMENTS

Figure 1B:
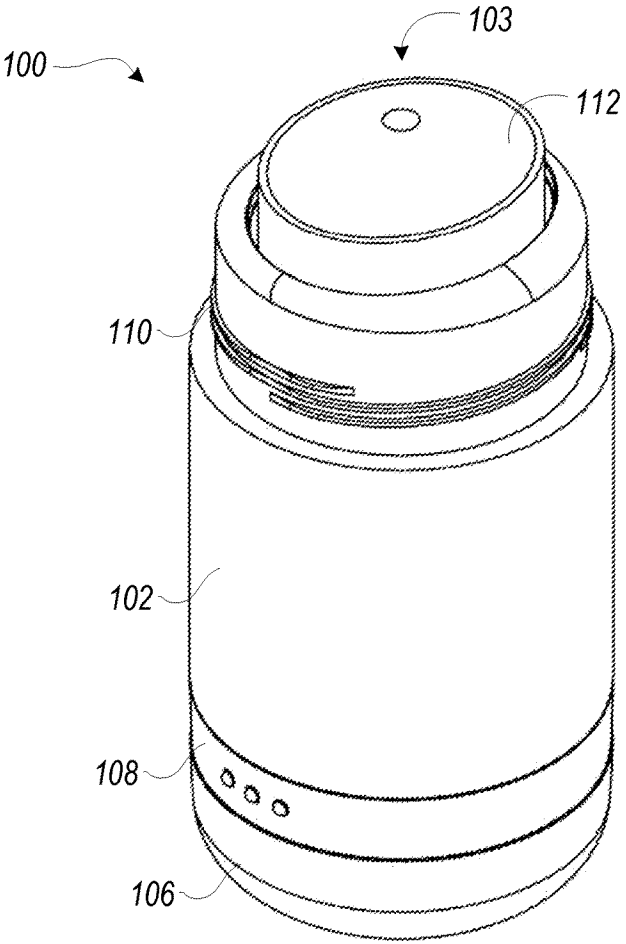
FIG. 1B illustrates a perspective view of the refillable container depicted in FIG. 1A, according to various embodiments.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical contact with each other. "Coupled" may mean that two or more elements are in direct physical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous.

Stick deodorants are so named due to their typical form factor: a "stick" that is housed in a container for handling. The container typically includes a tubular housing for holding the deodorant, with a top opening that exposes the end of the stick for application. The deodorant is typically placed upon a follower or plunger, which in turn engages a screw that runs through the center of the stick. The screw is connected to a rotatable cap or dial located on the end of the housing opposite to the top opening.

In use, the exposed end of the stick is rubbed under a user's underarms, which causes some of the stick to be applied to the user while wearing down the exposed end. As the end wears down, the rotatable cap or dial is rotated to cause the screw to turn, which in turn causes the follower or plunger to move toward the top opening. The stick, attached to the follower or plunger, is likewise extruded through the top opening, exposing more of the stick for further use. The deodorant reaches the end of its use when the follower is exposed, typically when it reaches the end of the screw. Following use, the container is typically disposed of, either by tossing in the trash, to end at a landfill, or by recycling, if the container is of a recyclable material. Either ending is less than ideal, as disposal in a landfill wastes resources, and recycling typically requires more energy (and thus is wasteful) to reprocess the container than if the container could be reused. While a refillable solid-stick container can be achieved in a handful of ways, various disclosed embodiments use a paper or pulp tube design to allow for recycling or composting.

The embodiments disclosed herein provide a refillable container and associated refill for a stick deodorant. The stick refill may be packaged in a throwaway, compostable, or recyclable liner that is simpler and requires less material, and less durable material, than the refillable container that accepts and encloses the stick refill, and/or may be manufactured from recyclable, compostable, or renewable materials, such as paper, natural fiber-based pulp material, biodegradable plastic, or other suitable material that is readily recyclable, compostable, or will degrade or deteriorate more rapidly than a container manufactured from plastic or similar container materials. The container operates similar to existing stick deodorants, except that the refill is removed from the container and disposed of upon being used up, with the container being retained to receive another refill. As a result, the disclosed container and refills generate less waste than conventional stick deodorant containers. Moreover, should a user wish to change deodorants, e.g. if a particular scent isn't to the user's liking, the refill can be swapped rather than discarding the entire container, further saving waste.

Figure 1A:
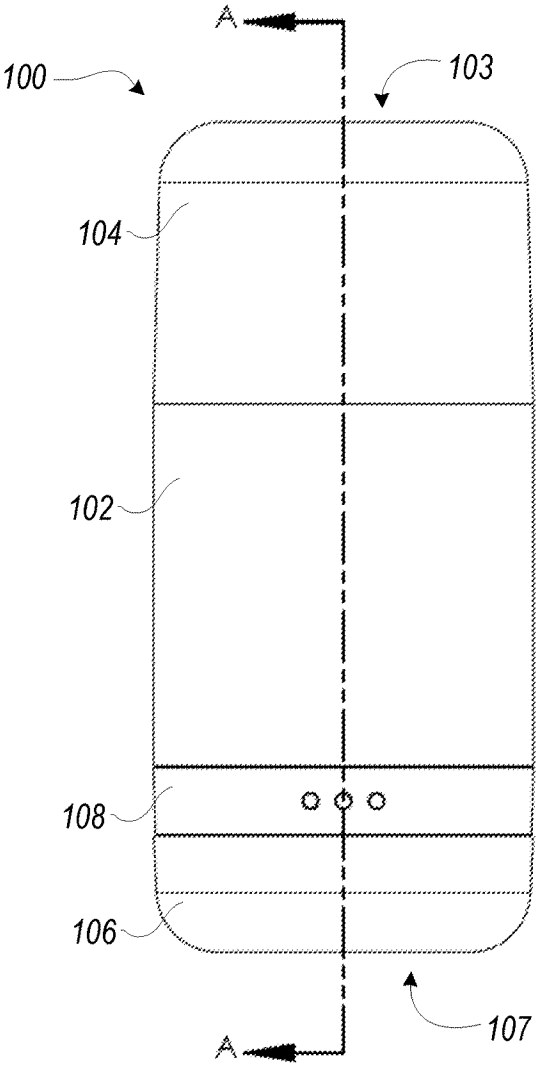
FIG. 1A illustrates an external side view of a refillable container for a stick deodorant, according to various embodiments.

FIG. 1A illustrates the externally visible components of a container 100 that accepts a refillable deodorant insert, according to embodiments. Container 100 includes a substantially tubular body 102, with a cap 104 that removably attaches to a first end 103 of the body 102, and a base 106 that secures to a second end 107 of the body 102 that is opposite the first end 103, as shown. Base 106 is secured or detached from body 102 by way of a locking collar 108, which may be manipulated, such as by partially turning, to either secure or detach base 106 from body 102.

FIG. 1B illustrates container 100 with cap 104 removed from first end 103. With cap 104 removed, a series of threads 110 on body 102 are exposed, to which corresponding threads on the inside of cap 104 engage when secured to first end 103 of body 102. When cap 104 is removed, the top of the deodorant stick 112 is exposed, ready for use. Turning base 106 (or a rotating portion of base 106) causes the top of deodorant stick 112 to be further pushed out of first end 103, as will be described herein. Although cap 104 is shown as securing to body 102 via threads 110, other ways of securing cap 104 may be implemented, such as a ridge over which cap 104 can snap, a latch mechanism on either cap 104 or body 102, or any other suitable mechanism for removably securing cap 104 upon body 102.

Body 102, in embodiments, is essentially a hollow tube that accepts an insert 200 (described below with respect to FIGS. 3A and 3B). In some embodiments, body 102 is substantially cylindrical, with a roughly circular cross section, viewed if cut radially across the longitudinal axis. In other embodiments, body 102 may have an oblong or ovoid cross section, similar to if a circular tube is partially crushed in a radial direction to form a long diameter and a short diameter. In still other embodiments, body 102 may comprise a polygonal cross section, such as a square, triangle, or other shape. It will be understood that insert 200 may be shaped to closely fit the inside shape and size of body 102, and so may have a cross section that matches the cross section of body 102. Cap 104, base 106, and locking collar 108 each may also have a similar cross section to body 102, so as to create a seamless appearance for container 100.

As mentioned above, both container 100 and corresponding insert 200 may be configured with a non-circular cross-section. A non-circular cross section can mechanically prevent insert 200 from rotating within container 100 when base 106 is rotated, instead of the screw 156, which may occur due to adhesion between deodorant stick 150 and the interior of tube 152 and thus prevent deodorant stick 150 from being driven up through tube 152. In other embodiments, container 100 may have an exterior cross-section that is circular, but with an interior cavity having a non-circular cross section to accept an insert 200 with a matching non-circular cross section.

In still other embodiments, the deodorant stick 150 and/or the interior of tube 152 that contacts deodorant stick 150 may be of a formulation, a material, coated, or otherwise prepared to reduce possible friction or adhesion between deodorant stick 150 and tube 152 sufficient to allow insert 200 and container 100 to have a circular cross-section. Other embodiments may permit a circular cross-section by mechanical means within the interior of container 100 that engages tube 152 to prevent its rotating with base 106. For example, the interior of container 100 may include one or more barbs or protrusions to engage the exterior of tube 152, aligned axially to allow insert 200 to be inserted into container 100 without binding, but otherwise preventing rotation of insert 200 once inserted. Tube 152 may be configured with corresponding features that work in cooperation with the barbs or protrusions, or otherwise work on their own to minimize or prevent rotation of insert 200 within container 100.

In some embodiments, base 106 is secured to body 102 via locking collar 108. Locking collar 108 may be configured to partially rotate to allow base 106 to disengage and detach from body 102, such as when insert 200 is to be replaced. Such engagement and disengagement may be accomplished by threads or flanges disposed on locking collar 108 that engage corresponding threads or flanges disposed on body 102, proximate to second end 107, and/or base 106. Locking collar 108 may include a latching mechanism such as a snap or lip, so as to retain locking collar 108 in a latched position, and by extension, base 106 secured to second end 107 of body 102. Locking collar 108 may be retained as part of either body 102, and so engage threads or a flange on base 106 to secure it to body 102, or as part of base 106, and so engage threads or a flange on body 102. Other possible embodiments may forego locking collar 108 in favor of a different type of latching mechanism, such as a snap, clamps, or any other retention mechanism that can releasably secure base 106 to body 102.

Figure 2A:
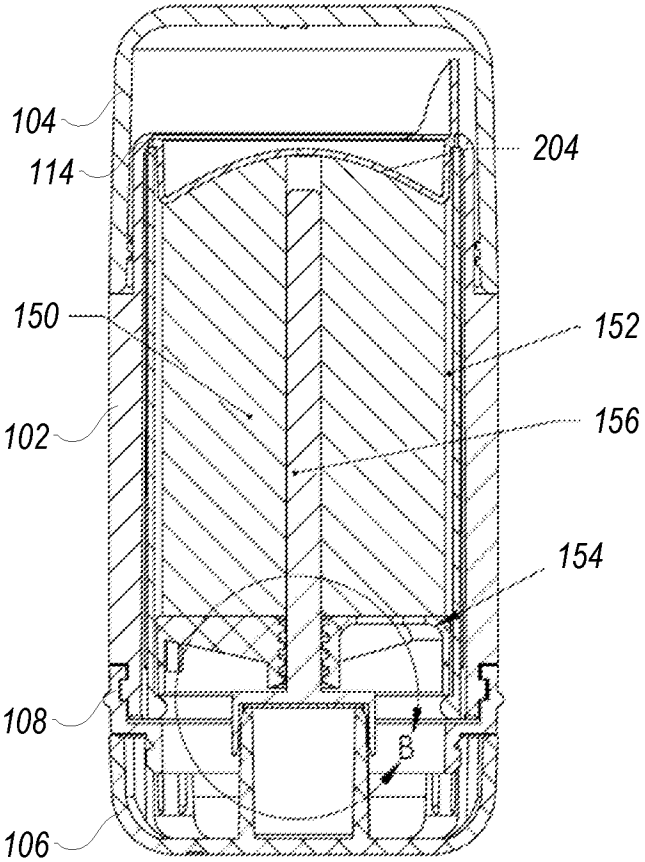
FIG. 2A is a cross-sectional view of section A-A of the refillable container depicted in FIG. 1A, according to various embodiments.

Referring now to FIG. 2A, a cross-sectional view of container 100 is depicted, along section A-A from FIG. 1A. In FIG. 2A, the placement of insert 200 within container 100 is shown, along with internal components used to advance a deodorant stick 150, contained within a tube 152 of insert 200, through body 102 and out through first end 103. Tube 152, when inserted into body 102, is retained in longitudinal position by engaging a retaining lip 114 formed into body 102 and located proximate to first end 103. Retaining lip 114, in the disclosed embodiment, prevents tube 152 from being expelled through first end 103 along with deodorant stick 150 as base 106 is rotated. Deodorant stick 150, contained within tube 152, rests upon and may be attached to a follower 154 that is also contained within tube 152. Follower 154 in turn engages a screw 156 that runs through the center of body 102 along its longitudinal axis.

As can be inferred from FIG. 2A, in embodiments, as screw 156 is turned, follower 154 is driven through tube 152, causing deodorant stick 150 to likewise be driven through tube 152. The engagement of tube 152 against retaining lip 114 prevents tube 152 from being carried up through body 102 due to friction or adhesion between deodorant stick 150 and the internal wall of tube 152 when follower 154 advances through tube 152. As a result, deodorant stick 150 is extruded from tube 152 and out through first end 103 as screw 156 is turned, leaving tube 152 in place. As the deodorant stick 150 is used up, eventually follower 154 reaches first end 103 and may be exposed, indicating to a user that the existing insert 200 is exhausted and should be replaced with a new insert 200.

Follower 154 is advanced by rotating screw 156, which itself interfaces with base 106. Base 106 includes a rotating portion, as mentioned above, or may be configured to rotate substantially as a whole. Thus, either base 106 or a rotating portion of base 106, depending upon the particular embodiment, may be rotated so as to impart a rotation to screw 156, and advance deodorant stick 150 through tube 152. In some implementations, screw 156 may be rotated either direction (clockwise or anticlockwise), resulting in follower 154, and by extension deodorant stick 150, either being extruded from tube 152, or drawn back down, which may be useful if a user inadvertently extrudes more deodorant stick 150 than is useable at a time, or otherwise would prevent cap 104 from being secured onto container 100. Some implementations may employ a one-way mechanism, such as a one-way clutch between base 106 and screw 156, that only allows screw 156 to be turned in the direction that advances deodorant stick 150.

Figure 2B:
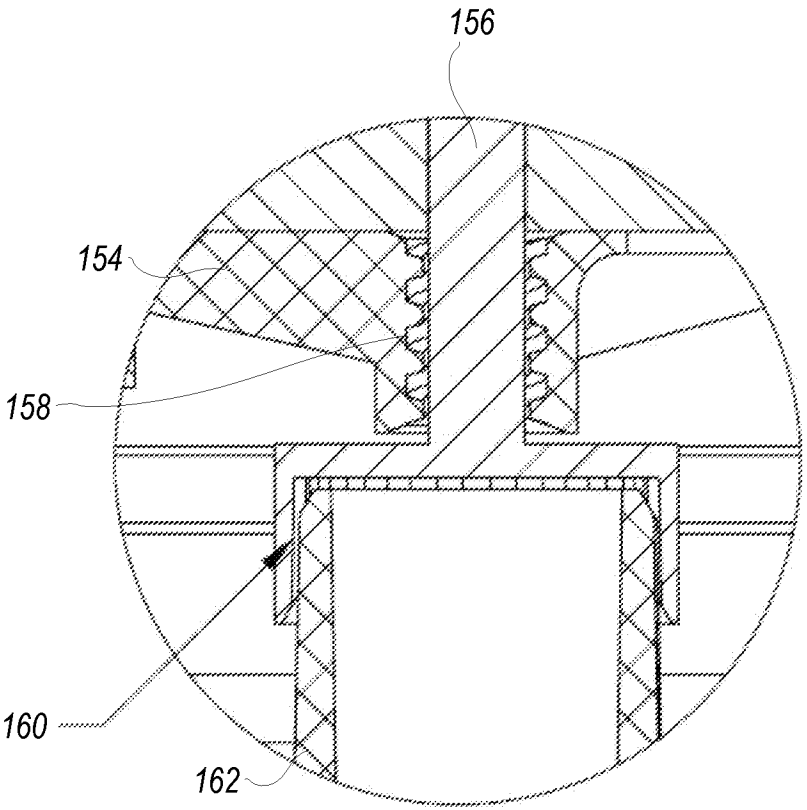
FIG. 2B is an inset view of Detail B from the cross-sectional view of FIG. 2A, according to various embodiments.

FIG. 2B shows Detail B, a close-up of the engagement between base 106 and screw 156. As depicted, rotating screw 156 includes a receiver 160, depicted as a cup, which enmeshes with driver 162, which is attached either to base 106 (where substantially all of base 106 rotates) or to a rotating portion of base 106. The enmeshing of receiver 160 and driver 162 causes rotational motion applied to base 106 or a rotating portion of base 106 to be imparted to screw 156. Also depicted in FIG. 2B is the threaded interface 158 between rotating screw 156 and follower 154. In one embodiment of threaded interface 158, rotating screw 156 may include one or more spiral threads upon its length that engage with corresponding spiral grooves located in follower 154. In another embodiment of threaded interface 158, rotating screw 156 may include one or more spiral grooves that engage with corresponding spiral threads located in follower 154.

The use of a threaded interface 158 is one possible implementation. Another possible embodiment that may be employed where container 100 has a substantially circular cross section is to employ threads on the inside surface of tube 152 that can interface with corresponding grooves (or vice versa) around the outside of follower 154. Rotation of follower 154 would then cause it to advance up through tube 152 by interaction with the threads located on the inside surface of tube 152. Follower 154 may be configured to be advanced through tube 152 in any suitable fashion.

Figure 3B:
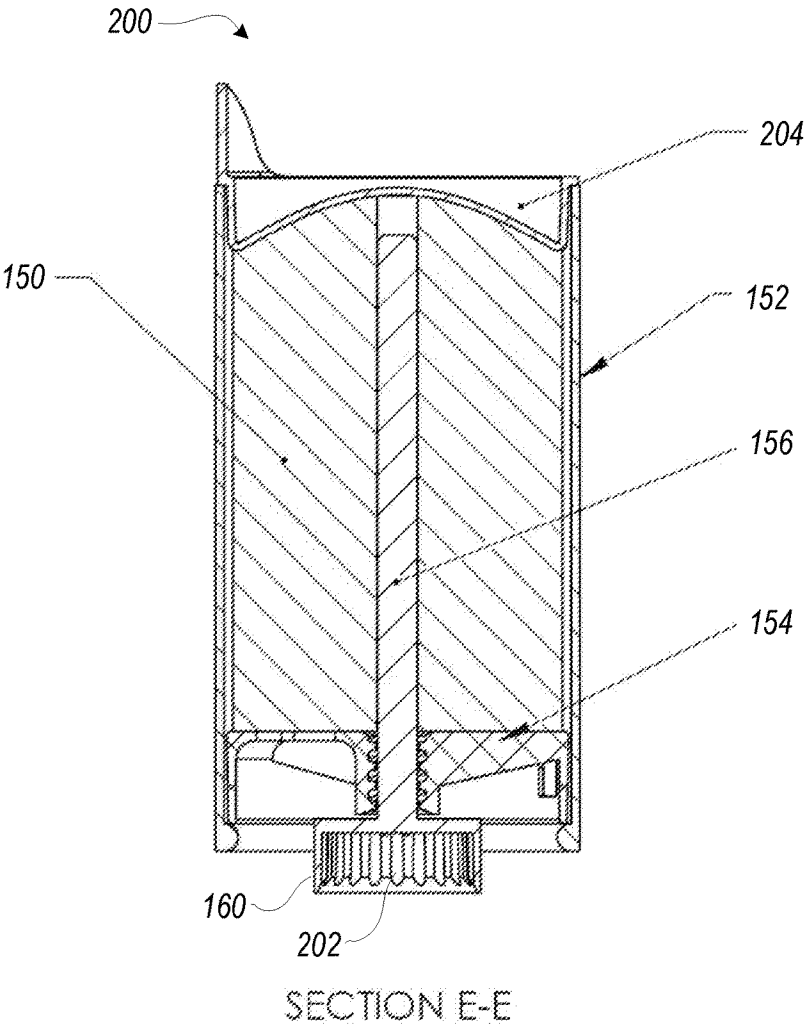
FIG. 3B is a cross-sectional view of section E-E of the stick deodorant insert depicted in FIG. 3A, according to various embodiments.
Figure 3A:
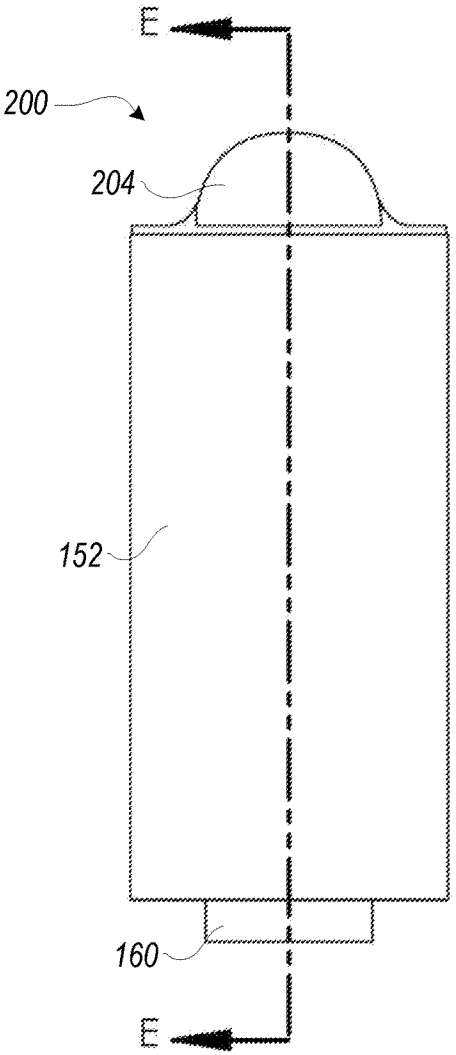
FIG. 3A illustrates an external side view of a stick deodorant insert that may be received by the refillable container depicted in FIG. 1A, according to various embodiments.

FIG. 3A depicts the outside view of an insert 200 that may be used to refill container 100. Insert 200, viewed externally, includes tube 152 to contain the deodorant stick 150 and allow for ease of handling insert 200 during insertion into container 100. Deodorant stick 150 may be covered with a removable protective cover 204 to maintain the quality of the deodorant until use. Also visible is receiver 160, which mates to driver 162 as described above to enable imparting of rotational motion to screw 156.

FIG. 3B depicts a cross section of insert 200 along section E-E of FIG. 3A. The internal components, also seen in FIG. 2B, include tube 152, follower 154, and rotating screw 156, described above. A cross section of receiver 160 is further depicted, showing a plurality of cogs 202 that may engage with corresponding cogs within driver 162. Cogs 202 help ensure that rotation of base 106 is imparted to screw 156 with little to no slippage. The use of cogs 202 is one possible implementation; any method of ensuring that driver 162 imparts rotational motion to receiver 160 may be employed. As mentioned above, some embodiments may employ a one-way clutch mechanism to impart rotation from driver 162 to receiver 160 when driver 162 is rotated in a first direction to cause screw 156 to advance follower 154 up through tube 152, but not impart rotation when driver 162 is rotated in a second direction.

Although receiver 160 is depicted as a socket into which driver 162 is inserted, other embodiments may invert the order, with receiver 160 inserting into a driver 162 that is implemented as a socket. Beyond a socket and inserting driver, receiver 160 and driver 162 may be configured in any suitable shape that allows for positive engagement between base 106 and insert 200 once insert 200 is inserted into body 102 and base 106 is secured to second end 107, and will reliably transmit rotational motion from base 106 or its rotating portion into rotating screw 156.

As may be understood from the figures, in the depicted embodiment a user can swap an empty insert 200 for a new insert 200 by first removing base 106 by rotating locking collar 108 into a release position, and pulling base 106 away from body 102. The empty insert 200, comprised of tube 152, follower 154, and rotating screw 156, is then removed from body 102 and discarded, such as by recycling. Afresh insert 200 is inserted into body 102. Protective cover 204 may be removed or retained until first use, depending upon the configuration of container 100. Base 106 is then placed onto second end 10 of body 102, and oriented to cause driver 162 to positively engage with receiver 160. Base 106 is secured and locked into place by rotating locking collar 108 back into its locked position.

The various components of container 100, including body 102, cap 104, base 106 and locking collar 108, may be manufactured from any suitable material, such as paper, plastic, metal, composite, or another suitable material. Likewise, the various components of insert 200, including tube 152, follower 154, rotating screw 156 with its attached receiver 160, and protective cover 204, may be manufactured from similar materials as the various components of container 100. The various components may all be manufactured from the same or different materials. In some embodiments, container 100 and/or insert 200 may be manufactured from recyclable, compostable, biodegradable, or similar such materials to minimize landfill impact once insert 200 is empty and/or container 100 has reached the end of its useful life.

In embodiments, deodorant stick 150 may be comprised of any suitable deodorant material, particularly designed to be used with a solid stick deodorant applicator. In other embodiments, deodorant stick 150 may be comprised of a gel or semi-soft or semi-fluid material, with either the top of tube 152, or the first end 103 of body 102, potentially configured with a grill or one or more apertures through which the deodorant material can extrude.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways.

This application is intended to cover any adaptations or variations of the embodiments discussed herein. Therefore, it is manifestly intended that embodiments be limited only by the claims and the equivalents thereof.

The invention claimed is:

1. A stick deodorant system, comprising:

a tubular container;

a base with a rotating portion;

a locking collar that secures the base to the tubular container when in a first position, and allows the base to be removed from the tubular container when in a second position; and an insert comprised of:

a deodorant stick;

a screw that extends longitudinally through a center of the deodorant stick;

a follower engaged with the screw such that rotating the screw causes the follower to move longitudinally through a center of the container; and a receiver disposed on an end of the screw, wherein the base engages with the receiver when the base is attached to the tubular container such that rotating the rotating portion of the base causes the screw to rotate, and wherein the base can be detached from the tubular container to allow the insert to be replaced.

2. The system of claim 1, wherein the base is the rotating portion.

3. The system of claim 1, wherein the rotating portion is a dial disposed upon the base.

4. The system of claim 1, wherein the tubular container and the insert each have a non-circular cross-section.

5. The system of claim 1, wherein the locking collar is retained to the base.

6. The system of claim 1, wherein the locking collar is retained to the tubular container.

7. A stick deodorant insert, comprising:

a tube with a hollow interior;

a deodorant stick with a first end and a second end, the stick disposed within the hollow interior;

a follower disposed upon the first end of the deodorant stick; and a rotating screw engaged with the follower and extended longitudinally through a center of the deodorant stick, wherein rotating the screw causes the follower and deodorant stick to move longitudinally through the tube such that the deodorant stick extrudes from the second end of the tube, wherein the screw includes a receiver that is configured to engage with a driver of a base of a stick deodorant container, and wherein the insert is configured to be retained, by a locking collar, within the stick deodorant container when the receiver is engaged with the driver of the base, the locking collar adapted to secures the base to the container when the locking collar is in a first position, and adapted to allow the base and insert to be removed from the container when the locking collar is in a second position.

8. The insert of claim 7, wherein the receiver is substantially cup-shaped.

9. The insert of claim 8, wherein the receiver includes an interior comprised of a plurality of cogs, the cogs configured to engage with corresponding cogs on the driver.

10. The insert of claim 7, wherein the tube has a non-circular cross-section.

11. The insert of claim 7, wherein the tube is comprised of a recyclable or compostable material.

* * * * *